United States Patent [19]

Pejouhy et al.

[11] Patent Number: 4,555,686

[45] Date of Patent: Nov. 26, 1985

[54] SNAP-ACTING THERMOSTATIC SWITCH ASSEMBLY

[75] Inventors: Radi Pejouhy, Marshfield; Wilfred W. Cardin, Attleboro, both of Mass.

[73] Assignee: Texas Instruments Incorporated, Dallas, Tex.

[21] Appl. No.: 614,621

[22] Filed: May 29, 1984

[51] Int. Cl.[4] ..... H01H 61/01; H01H 71/16

[52] U.S. Cl. ..... 337/102; 337/94

[58] Field of Search ..... 337/102, 103, 104, 107, 337/112, 94, 86, 93, 82

[56] References Cited

U.S. PATENT DOCUMENTS 3,452,313 6/1969 Perry ..... 337/86

4,231,010 10/1980 Cardin ..... 337/82

*Primary Examiner*—Harold Broome

*Attorney, Agent, or Firm*—John A. Haug; James P. McAndrews; Melvin Sharp

[57] ABSTRACT

A snap-acting thermostatic electric switch in which a snap-acting thermostatic disc is physically attached to a heater plate which in turn mounts movable contacts. A stepped rivet loosely mounts the disc and is headed over to tightly mount any one of a series of heater plates having different thicknesses. The heater plate is shaped to allow unimpeded snap motion of the disc yet provide improved heat conduction to the disc. The disc and plate are mounted on a spider support which is adjustably positioned within the switch compartment by means of a combination rivet and screw received in a threaded bore of the base of the switch. An insulator is loosely received on the base and is biased thereagainst by a spring which also biases the spider upwardly to provide positional stability. Another spring is placed between the spider and the heater plate to optimize contact opening.

11 Claims, 5 Drawing Figures

SNAP-ACTING THERMOSTATIC SWITCH ASSEMBLY

The invention relates generally to temperature-responsive switches and more particularly to such switches for use in protection circuits for motors and the like. Switches of the type to which the invention is addressed are shown in U.S. Pat. Nos. 3,452,313 and 4,231,010. In those switches, a resilient snap-acting thermostatic disc and a heater plate are combined in a subassembly to achieve desired thermal response and arc shielding characteristics. Movable contacts are carried by the heater plate. A support for the subassembly is located on a base member by means of an elongated element such as a screw member or a knurled stud so that, as the thermostatic disc moves in response to selected temperature changes, the movable contacts engage and disengage stationary contacts on the base member, thereby to open and close switch circuits in response to the temperature changes. The screw member or knurled stud is adjustably movable along its longitudinal axis to move the subassembly relative to the base member for calibrating the switch and is locked in its calibrated position by conventional means.

As shown in the patents, a cup shaped ceramic insulator is fixed to the base member by adhesive or the like and surrounds each of the stationary contacts to provide an arc shield for the base member and cover as well as arc shadows to prevent tracking. Although the cup shaped insulator is effective, there are times when the adhesive used to fix the insulator to the base member is not evenly distributed so that the insulator is slightly skewed and as a result, the distal portion of the rim is sometimes chipped when the cover is placed on the base member during assembly. The presence of loose particles in the enclosure is undesirable and results in an unacceptable switch.

Further, in particular relation to the first mentioned patent, supra, the switch calibration system is somewhat expensive and entails some manufacturing and assembly operations which are inconvenient and uneconomical. For example, mounting of the adjusting screw member on the base member requires careful tapping of the base member. Close tolerances are required in several components and careful assembly is required for rotatably attaching the adjusting screw to the subassembly support in order to assure proper temperature response of the switch. In addition, some undesirable wobbling of the subassembly support can occur when the adjusting screw is being rotated during switch calibration and if the screw member is too lose in the base member wobbling can occur even after calibration thereby rendering the switch position sensitive. U.S. Pat. No. 4,231,010 provides one solution by using a stud to mount the subassembly support. A knurled portion of the stud is received in a bore of the base member which allows precise, fixed location of the stud and a rivet portion of the stud in turn mounts the subassembly supppot. However in implementing this design a problem has arisen due to the hardness of the base member caused by the heat treating effect when raising the temperature of the base member sufficiently to obtain a suitable glass seal. Stud members made of conventional material are not hard enough to prevent stripping of the knurled portion during insertion into the bore of the base member. While materials are available to overcome this problem they are more expensive or not readily available.

It is therefore an object of the invention to provide an improved snap-acting thermostatic switch which is less expensive both in material and in assembly yet which has position insensitivity and displays good thermal response characteristics and a long service life.

Briefly, in accordance with the invention the improved thermostatic switch comprises a subassembly of a snap-acting thermostatic disc and a heater plate centrally affixed to one another by means of a unitary rivet element. The heater plate has a first flat portion lying in a plane mounting three contacts thereon and a second portion lying in a plane spatially displaced from the first plane to allow unimpaired snapping of the disc while maintaining optimum heat transfer from the heater to the disc. The unitary rivet element is provided with a step having a depth slightly greater than the snap-acting disc in order to loosely mount the disc with the rivet headed over to tightly engage the heater, which may be of various thickness to provide different switch ratings.

The insulator is formed as a flat member with a triangular cut out portion which receives a raised platform portion of the base member to maintain the insulator in a desired orientation so that the walls of terminal apertures formed in the insulator are spaced from the terminals. The terminals each mount a stationary contact alignable with a contact on the heater. The insulator is loosely received on the base member with a three legged spring member placed between the insulator and a support spider to bias the insulator against the base member and provide positional stability to the support spider.

The support spider is mounted on the end of a screw which is received in a bore extending through the base member, and has three arms projecting from a hub, each arm terminating in an inwardly opening hook. The disc has three bifuracted ears with a hook received in each bifurcating slot and a wire retainer ring is placed between the ears of the disc and the top surface of the hook to conveniently mount the disc and heater subassembly to the spider. The screw is rotated to adjust the position of the spider and concomitantly the contacts carried by the heater to thereby calibrate the device. One of the arms of the spider has a pair of downwardly depending legs which are received in a pair of cut out portions in the insulator to maintain a desired angular orientation of the spider and concomitant alignment of the movable contacts on the heater with their respective stationary contacts. A nut and epoxy are applied to the screw in the adjusted position to permanently fix the position of the spider relative to the base member. A spring member is preferably placed between the spider and the heater to ensure maximum contact opening between each pair of contacts.

The provision of a flat insulator loosely received on the base member with a preselected angular orientation essentially obviates the cracking problem associated with the adhesively attached cup shaped insulator. The three legged spring member maintains the insulator firmly seated on the base member while at the same time adds positional stability to the spider and avoids wobbling problems normally associated with centrally mounted spiders. The heater and disc are attached to one another using fewer parts and which results in a smaller total dimensional tolerance among the several parts than in previous embodiments while providing optimum heat transfer and allowing unimpaired snapping of the disc.

Other objects, advantages and details of the novel and improved switch of the invention appear in the following detailed description of preferred embodiments of the invention, the detailed description referring to the drawings in which.

Figure 1:
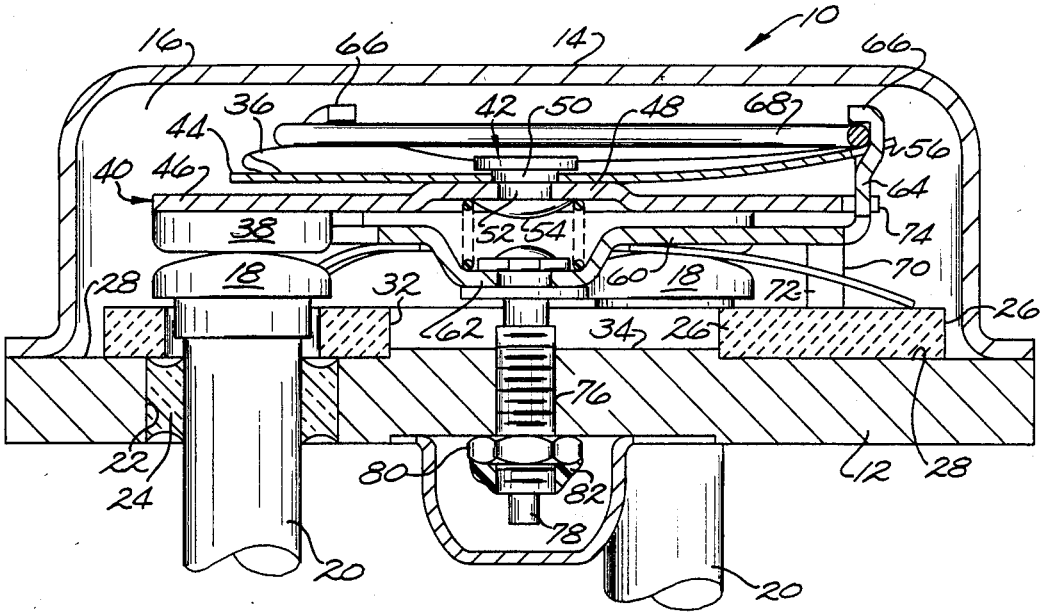
FIG. 1 is a sectional view along line 1—1 of FIG. 3 illustrating the switch in closed circuit position
Figure 2:
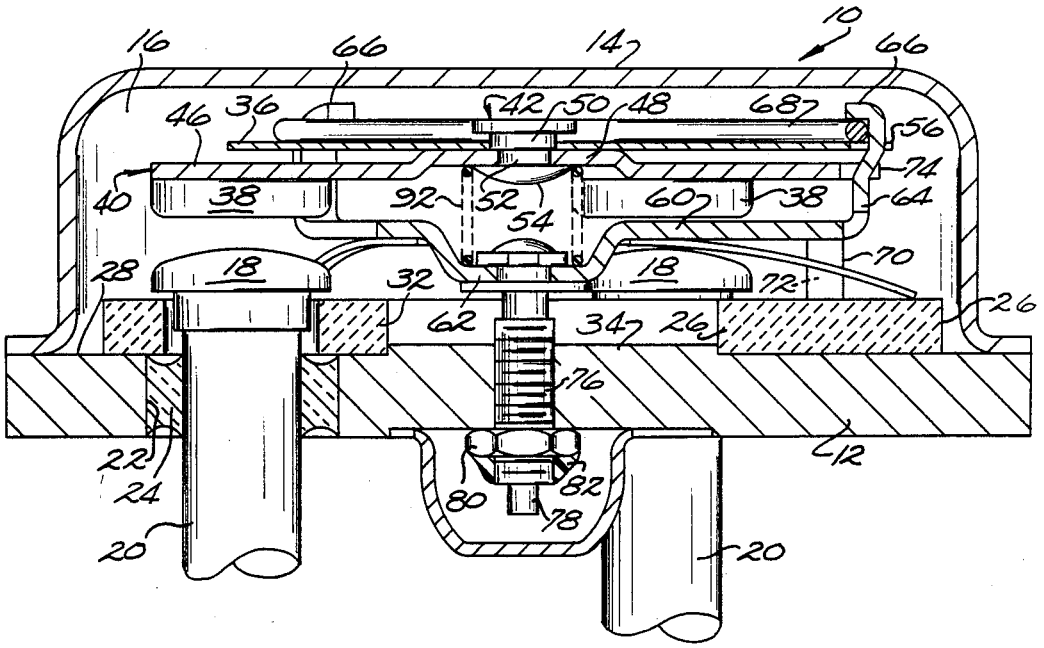
FIG. 2 is a sectional view similar to FIG. 1 illustrating the switch in open circuit position.
Figure 3:
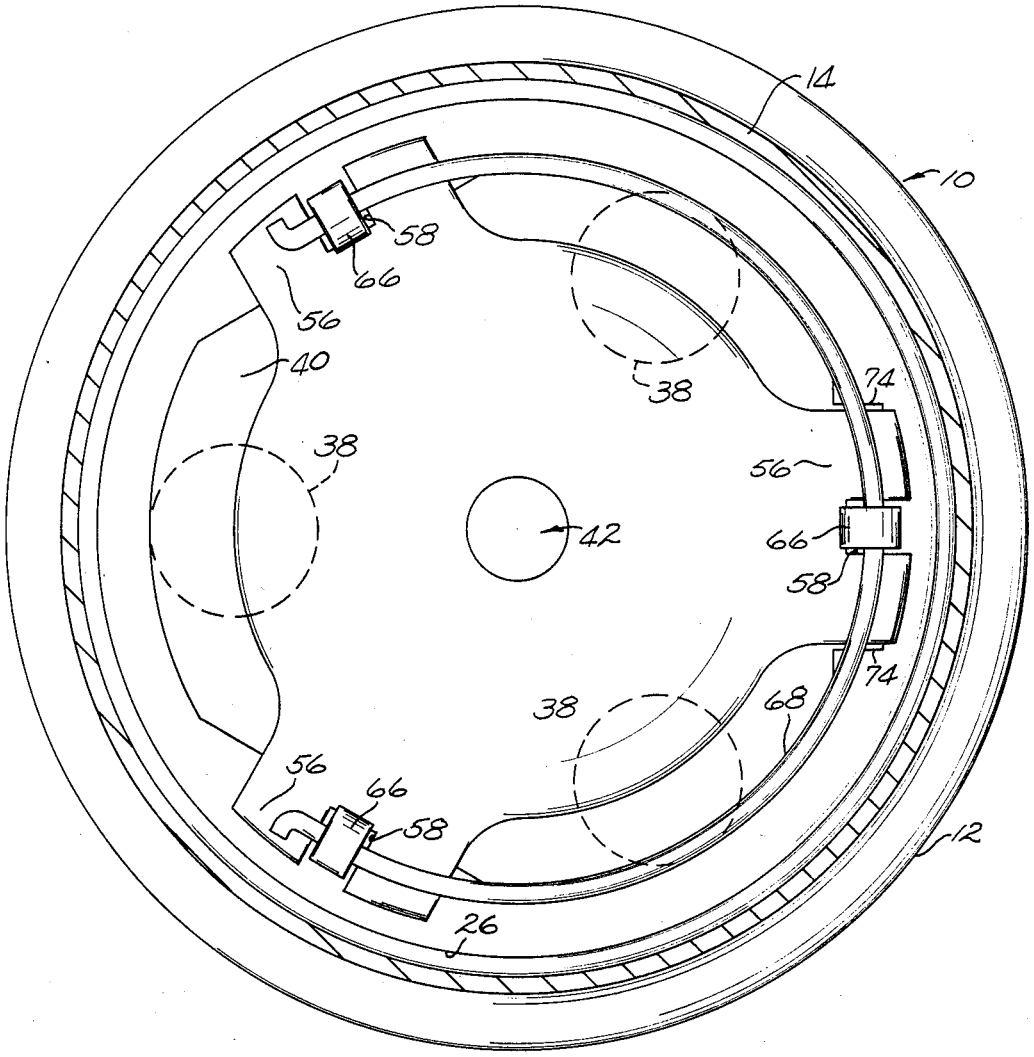
FIG. 3 is a sectional view along line 3—3 of FIG. 1.

Referring to the drawings, numeral 10 in FIGS. 1-3 indicates the novel and improved switch of the invention which is shown to include a generally circular base member or header 12 of suitable metal, such as cold rolled steel. Typically a cover 14 is welded to the base to form an hermetically sealed switch compartment 16 for enclosing the operating components of the switch. Stationary electrical contacts 18 are mounted on the base. Preferably, for example, three terminals 20 spaced 120 degrees apart from one another are mounted in respective openings 22 in the base and are sealed, secured and electrically insulated from the base by conventional glass seal means 24. The stationary contacts 18 are welded or otherwise mounted on the ends of respective terminals 20. Terminals 20 are preferably composed of composite material such as one having an outer layer of stainless steel bonded to a core of copper to provide optimum thermal and electrical characteristics as well as facilitating sealing of the terminal and welding of the contact thereto.

A generally flat circular electrical insulator 26, preferably of suitable ceramic material is received on an inner surface 28 of base member 12. Insulator 26 is provided with terminal receiving apertures 30 which are spaced from the terminals to provide both an arc shield and an arc shadow to break up any arc tracking which may occur. By making the active part of the thermostatic disc slightly smaller in diameter (that is the circular portion) than is employed in the above mentioned patents it was found that the upstanding rim portion of the insulators used in those patents is not required, that the disc is sufficiently shielded from the arc by the heater. Insulator 26 is formed with a centrally located cut out portion 32 shown as triangular in configuration and receives therein a correspondingly configured raised platform 34 of base member 12. Platform 34 serves to maintain a predetermined, selected angular orientation of the insulator to insure that the walls of terminal apertures 30 are maintained separated from the terminals to provide a desired arc shadow. It will be understood that other non-circular configurations can be used to provide the desired orientation, if desired.

In the switch of this invention, a snap-acting thermostatic disc element 36 is mounted on base 12 and is associated with movable contact 38 so that when the temperature changes, the movable contacts engage and disengage the stationary contacts 18 to close and open a switch circuit in response to the temperature changes. Preferably the snap-acting disc 36 comprises a generally conventional resilient, dished bimetallic element (only one layer being shown for clarity of illustration) which has its central part fixedly secured to an electrically conductive metal heater plate 40 of high resistance metal or the like by means of a rivet 42 to form a subassembly 44. Heater 40 has a first generally flat portion 46 which lies in a first plane maintained generally parallel to inner surface 28 of base member 12. Portion 46 mounts thereon three movable contacts 38 spaced 120 degrees apart so that they are alignable with the stationary contacts 18. Heater 40 has a second generally flat central portion 48 which lies in a second plane parallel to and spaced from the first plane in a direction toward the disc in order to allow the disc to snap with unimpaired motion, that is without any interference from the heater while at the same time providing optimum heat transfer to the disc. Rivet 42 has a first step or diameter portion 50 which extends in a longitudinal axial direction somewhat longer than the thickness of disc 36 so that the disc is loosely mounted. A second, smaller diameter rivet portion 52 receives heater 40 with its distal free end headed over at 54 to tightly engage the heater. This arrangement permits the mounting of any one of a whole series of heater plates using but a single size revet. That is, in order to provide a switch particularly suitable for different motor ratings different heaters are employed with the remaining structure of the switch remaining the same. For example, the thickness of the heater may vary typically from 0.020 inch to 0.040 inch in increments of 0.002 inch. In former devices this would require a different size bushing for each different heater however by mounting the heater directly on end portion 52 that portion can be headed over to accommodate any of the different heater thicknesses. This not only decreases inventory requirements but also obviates possible mismatches of bushings and heaters.

Thermostatic disc 36 has marginal ears 56 which are bifurcated by slots 58 as shown particularly in FIG. 3 and a disc support spider 60 is arranged to mount the subassembly 44 so that the disc 36 is permitted to move in response to temperature changes. Spider 60 has a hub 62 with three arms 64 extending outwardly therefrom terminating at a free distal end in a hook 66 with the hook open inwardly or toward the center. A snap or spring retaining ring 68 fits into hooks 66 over the disc ears to mount subassembly 44 on spider 60.

Figure 4:
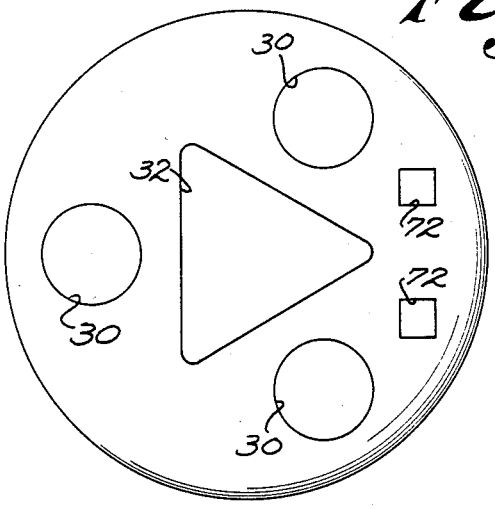
FIG. 4 is a top plan view, of smaller scale, of an insulator used in the switch.

One of arms 64 of spider 60 is provided with a pair of downwardly extending legs 70 which is received in an additional cut out portion of insulator 32, generally rectangular apertures 72 shown best in FIG. 4. A preselected angular orientation of spider 60 is thereby maintained. Angular orientation of subassembly 44 is maintained by a pair of tabs 74 which extend from heater 40 and stradle one of the arms 64. Thus alignment of movable contacts 38 relative to stationary contacts is assured.

Spider 60 is mounted on the distal end of an elongated element 76. Element 76 may be a combination rivet and screw member with hub 62 of the spider affixed to the rivet end through a swivel connection and the screw end can be rotated by means of a flattened end portion 78 to adjust the location of the rivet end within compartment 16. Subassembly 44 is precisely positioned relative to base member 12 for calibrating switch 10. That is, the subassembly is moved downwardly so that the movable contacts 38 of the switch bear against the stationary contacts with a selected force when the switch is in closed circuit position at a first selected temperature as illustrated in FIG. 1, the alignment of the contacts being maintained through legs 70 and tab 74. When the thermostatic disc 36 is at a second, actuating temperature, the disc moves to the position shown in FIG. 2 for opening the switch circuit. When the spider is located in its desired position, nut 80 is tightened against the bottom surface of base member 12 and locked at that position by epoxy 82. Preferably a cap 84 is received over element 76 and is attached to base member 12 in a conventional manner, as by welding to complete the hermetic sealing of the switch compartment.

Figure 5:
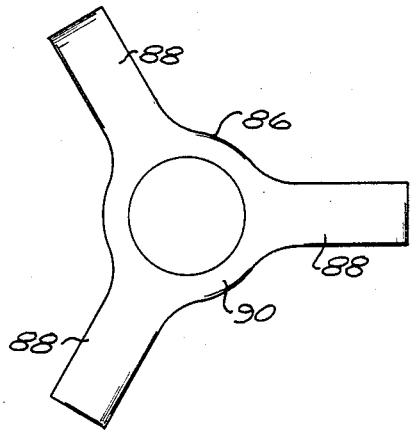
FIG. 5 is a top plan view, of smaller scale, of a spring member used in the switch.

As described supra, insulator 26 is loosely received on inner surface 28 of the base member. A spring member 86 of suitable material, such as stainless steel, is disposed between a top surface of insulator 26 and spider 60. As seen in FIG. 5, spring member 86 preferably has three legs 88 extending out from a central ring portion 90. Ring portion 90 is received around hub 62 of spider 60 with legs 88 disposed between respective pairs of stationary contacts 18. Spring member 86 biases insulator 26 firmly against inner surface 28 as well as biasing spider 62 upwardly to provide positional stability for the spider support. This prevents any tendency the spider might otherwise have to wobble and deleteriously effect the calibration of the switch.

A second spring member 92, such as a coil spring is preferably disposed between spider 60 and heater 40 in order to take up looseness among the several parts and maintain maximum contact gap between each respective pair of movable and stationary contacts when in the open circuit position.

It should be understood that the preferred embodiment of the switch of this invention has been described above by way of illustrating the invention but that the invention includes all modifications and equivalents of the disclosed embodiments which fall within the scope of the appended claims.

I claim:

1. A thermostatic switch assembly comprising a metallic base member and a cover attached to the base member forming therewith a switch compartment, the base member having an inner surface, a plurality of apertures extending through the base member, a terminal pin extending through each aperture in electrical insulating relationship with the base member by glass sealing means, an electrical insulator disposed on the inner surface, the insulator having an aperture therethrough for each terminal pin, each terminal pin having an end extending through a respective insulator aperture and disposed in the switch compartment spaced a selected distance from the inner surface, a stationary contact mounted on the end of each terminal pin, a movable contact assembly mounted in the compartment comprising on elongated element mounted on the base member and having a distal end portion disposed in the compartment, a spider mounted on the distal end portion, the spider having a plurality of arms extending transversely over the inner surface, each arm having an inwardly disposed hook, a heater plate having a plurality of contacts mounted on a surface thereof, a snap-acting, thermally responsive disc having a plurality of ears projecting therefrom, the disc and the heater plate being centrally attached to one another, the ears of the disc each having a bifurcating slot with a respective spider hook received through the slot, a wire retainer received in each hook between the hook and its respective ears of the disc to mount the heater plate and the disc to the spider, the disc adapted to snap from a first configuration with the contacts on the heater plate in engagement with respective stationary contacts to a second configuration with the contacts on the heater plate out of engagement with the stationary contacts, characterized in that the electrical insulator is loosely received on the inner surface of the base member and a spring member is disposed between the insulator and the spider to bias the insulator firmly against the base member and to stabilize the position of the movable contact assembly.

2. A thermostatic switch assembly according to claim 1 in which the insulator is formed with a cut out portion of a selected configuration and the base member is provided with a platform extending above the inner surface, the platform having a configuration corresponding to that of the cut out portion of the insulator, the platform received in the cut out portion to maintain the insulator in a predetermined orientation relative to the terminal pins with selected spacing provided between the insulator and each terminal pin and stationary contact.

3. A thermostatic switch assembly according to claim 2 in which the insulator is formed with an additional cut out portion, and the spider has a downwardly depending leg received in the additional cut out portion to ensure a predetermined angular orientation of the spider relative to base member.

4. A thermostatic switch assembly according to claim 3 in which the additional cut out portion comprises a pair of rectangular apertures and the spider has a pair of downwardly depending legs received in the pair of apertures.

5. A thermostatic switch assembly according to claim 1 in which the heater plate has a first portion having a generally flat surface lying in a first plane with the contacts mounted on the first portion, the heater plate having a second centrally located portion having a generally flat surface lying in a second plane spaced from the first plane, the second plane being closer to the disc than the first plane in order to provide space for the disc to snap from one configuration to the other while maintaining the disc and heater plate in optimum heat transfer relation.

6. A thermostatic switch assembly according to claim 2 in which the cut out portion is triangular in configuration.

7. A thermostatic switch assembly according to claim 1 in which the base is circular, there are three terminal pins mounted in the base spaced 120 degrees from one another and the spring member has three legs, a leg disposed between respective pairs of the terminal pins.

8. A thermostatic switch assembly according to claim 1 in which a second spring member is disposed between the spider and the heater plate to provide maximum contact opening for all the contacts.

9. A thermostatic switch assembly comprising a metallic base member, a cup shaped cover attached to the base member forming therewith a switch compartment, the base member having an inner surface, a plurality of apertures extending through the same base member, a terminal pin extending through each aperture in electrical insulating relationship with the base member by glass sealing means, an electrical insulator disposed on the inner surface, the insulator having an aperture therethrough for each terminal pin, each terminal pin having an end extending through a respective insulator aperture and disposed in the switch compartment spaced a selected distance from the inner surface, a stationary contact mounted on the end of each terminal pin, a movable contact assembly mounted in the compartment comprising an elongated element mounted on the base member and having a distal end portion disposed in the compartment, the elongated element having a longitudinal axis and being adjustably movable along its longitudinal axis, a spider mounted on the distal end portion of the element, the spider having a plurality of arms, each arm terminating in a hook, a heater plate having a generally flat portion mounting a plurality of movable contacts and a centrally located mounting portion, a snap-acting, thermally responsive, generally circular disc having a centrally located mounting portion and a plurality of ears projecting outwardly from the disc, the ears of the disc each having a bifurcating slot with a respective spider hook received through the slot, a rivet joining the heater plate and the disc at the centrally located mounting portions, a wire retainer received in each hook between the hook and the ears of the disc to mount the heater plate and disc to the spider, each movable contact on the heater plate aligned with a respective stationary contact, the disc adapted to snap from a first configuration with the movable contacts in engagement with respective stationary contacts to a second configuration with the movable contacts out of engagement with respective stationary contacts characterized in that the centrally located mounting portion of the heater plate is displaced toward the disc relative to the flat portion of the heater plate, the heater plate being fixed relative to the rivet and the disc being loosely received on the rivet.

10. A thermostatic switch assembly according to claim 9 in which the insulator is loosely received on the base member and a spring member is disposed between the insulator and the spider.

11. A thermostatic switch assembly according to claim 10 in which the insulator is formed with a cut out portion of a selected configuration and the base member is provided with a raised platform having a configuration corresponding to that of the cut out portion of the insulator, the platform received in the cut out portion to maintain the insulator in a predetermined orientation relative to the terminal pins with selected spacing provided between the insulator and each terminal pin.

* * * * *